US005518867A

United States Patent [19]

Anderson et al.

[11] Patent Number: 5,518,867

[45] Date of Patent: May 21, 1996

[54] ELECTRON BEAM RECORDING PROCESS UTILIZING AN ELECTRON BEAM RECORDING FILM WITH LOW VISUAL AND ULTRAVIOLET DENSITY

[75] Inventors: Charles C. Anderson, Penfield; David A. Niemeyer, Rochester; David F. Jennings, Penfield, all of N.Y.

[73] Assignee: Eastman Kodak Company, Rochester, N.Y.

[21] Appl. No.: 394,996

[22] Filed: Feb. 27, 1995

Related U.S. Application Data

[62] Division of Ser. No. 241,823, May 12, 1994, abandoned.

[51] Int. Cl.[6] ..... G03C 7/00; G03C 1/85; G03C 1/76

[52] U.S. Cl. ..... 430/363; 430/529; 430/530; 430/533; 430/537; 430/942; 430/950

[58] Field of Search ..... 430/363, 527, 430/529, 530, 533, 537, 539, 942, 950

[56] References Cited

U.S. PATENT DOCUMENTS

| | | | |
|---|---|---|---|
| 3,428,451 | 2/1969 | Trevoy | 96/1 |
| 4,203,769 | 5/1980 | Guestaux | 430/631 |
| 4,495,276 | 1/1985 | Takimoto et al. | 430/527 |
| 4,837,135 | 6/1989 | Milner | 430/524 |
| 5,006,451 | 4/1991 | Anderson et al. | 430/527 |
| 5,221,598 | 6/1993 | Anderson et al. | 430/527 |
| 5,310,640 | 5/1994 | Markin et al. | 430/527 |
| 5,340,676 | 8/1994 | Anderson et al. | 430/527 |
| 5,360,706 | 11/1994 | Anderson et al. | 430/527 |
| 5,366,855 | 11/1994 | Anderson et al. | 430/530 |
| 5,439,785 | 8/1995 | Boston et al. | 430/530 |
| 5,455,153 | 10/1995 | Gardner | 430/530 |
| 5,466,567 | 11/1995 | Anderson et al. | 430/530 |

FOREIGN PATENT DOCUMENTS

| | | | |
|---|---|---|---|
| 05119433 | 5/1993 | Japan | 430/533 |

*Primary Examiner*—Charles L. Bowers, Jr.
*Assistant Examiner*—J. Pasterczynk
*Attorney, Agent, or Firm*—Alfred P. Lorenzo

[57] ABSTRACT

An electron-beam-recording process comprises the steps of (1) providing an electron-beam-recording element, (2) introducing the element into a vacuum chamber, (3) imagewise exposing the element within the vacuum chamber to an electron beam and (4) processing the imagewise-exposed element to form a visible image. The electron-beam-recording element comprises a film support having, in order, on one side thereof a conductive layer comprising vanadium pentoxide, an adhesion-promoting hydrophilic colloid layer and an imaging layer. The imaging layer is comprised of an electron-beam-sensitive silver halide emulsion and the vanadium pentoxide is present in the conductive layer in an amount sufficient to impart thereto a resistivity of less than $5\times10^8$ Ω/sq.

20 Claims, No Drawings

ELECTRON BEAM RECORDING PROCESS UTILIZING AN ELECTRON BEAM RECORDING FILM WITH LOW VISUAL AND ULTRAVIOLET DENSITY

This is a division of application Ser. No. 241,823, filed May 12, 1994, and now abandoned in favor of continuation application Ser. No. 443,638, filed May 18, 1995.

FIELD OF THE INVENTION

This invention relates in general to an imaging element for use in electron beam recording and in particular to an imaging element comprising both a conductive layer and an electron-beam-sensitive silver halide emulsion layer. More specifically, this invention relates to an imaging element for use in an electron beam recording process which provides low visual and ultraviolet (UV) density and is free of objectionable mottle.

BACKGROUND OF THE INVENTION

Electron beam image recording applications include, for example, automated cartography (see "The Versatility of Electron Beam Techniques for Image Recording", U.S.A.F. Symposium on Image Display and Recording, p. 273, April 1969, "Electron Beam Image Recording Applications", ELIM'S-70 Symposium, p. 199, April 1970, and "Investigations of the Use of Conventional Films In the ETL Cartographic EBR, Government Report ETL-0177, Mar. 15, 1979) and involve the direct imaging of silver halide photographic emulsions with high energy (e.g., 15 KeV) electrons. Such imaging techniques afford the potential of very high resolution due to the short effective wavelength and high productivity due to independent x and y positioning.

Silver halide emulsions suitable for use in an electron beam recording process are well known and are described, for example, in U.S. Pat. No. 3,428,451, issued Feb. 18, 1969, and U.S. Pat. No. 4,837,135, issued Jun. 6, 1989 and references cited therein.

During the imaging process, impingement of electrons on the imaging media generates a space charge within the media due to both capture of the imaging electrons and to hole generation which arises as a result of secondary electron emission. With electrons in the 15 to 20 KeV range, the space charge that results is predominately negative in sign. This negative charge generation and the resulting repulsion of the imaging electrons can lead to such problems as geometric or positional image distortions, spurious changes in image resolution, and variations in optical density of the recorded image unless an adequate ground plane is maintained in close proximity to the space charge. Ideally, this ground plane is provided by a conductive layer incorporated within the imaging media between the film support material and the imaging layer. The maximum resistivity of this conductive layer is in part a function of the path length to ground and the grounding mechanism. For grounding at the edge of narrow width film, i.e., short path lengths, resistivities less than about $5\times10^8$ Ω/sq are required. Longer path lengths require even lower resistivities.

Electron beam recording film images are typically used as originals for the generation of secondary images, e.g., lithographic plates and cartographic prints, and, therefore, must have a low processed $D_{min}$ in both the UV and visible wavelength and must exhibit a high degree of uniformity. A UV $D_{min}$ of no greater than 0.12 density units, preferably no greater than 0.10 is needed. The uniformity of the UV density across the film is preferably at least within ±0.02. A visible $D_{min}$ of no greater than 0.07, preferably no greater than 0.04, is also required.

A variety of materials have been described for use in conductive layers on conventional photographic films. Typically, the conductivity of these layers is sufficient to provide antistatic protection that helps minimize problems such as static marking and dirt and dust attraction that may otherwise result from triboelectric charging of photographic films during manufacture and use. To provide antistatic protection to the photographic films the resistivities of these conductive layers need to be less than about $10^{11}$ Ω/sq. Antistatic layers comprising ionically conductive materials such as inorganic salts, colloidal silicas, polymeric salts such as sulfonic acid salt homopolymers and interpolymers are well known in the art. However, the electron beam imaging process requires that the actual imaging be done at very high vacuum, thus, ionically conductive materials that require the presence of moisture to solvate the conductive species are incapable of providing the required resistivity values under the high vacuum, extremly low humidity conditions of the imaging process.

Electronically conductive materials such as semiconductive metal salts, for example, cuprous iodide, described in U.S. Pat. Nos. 3,245,833, 3,428,451 and 5,075,171 reportedly provide resistivities less than $10^7$ Ω/sq. However, these conductive layers have high UV densities and are typically applied from harmful solvents such as acetonitrile which also makes them undesirable from a health and environmental standpoint. In addition, these cuprous iodide/acetonitrile coating compositions lead to conductive layers that exhibit a "mottled" appearance.

Conductive layers comprising inherently conductive polymers such as polyacetylene, polyaniline, polythiophene, and polypyrrole are described in U.S. Pat. No. 4,237,194, JP A2282245, and JP A2282248, but these layers are highly colored.

Conductive fine particles of crystalline metal oxides dispersed with a polymeric binder have been used to prepare humidity-insensitive, conductive layers for various imaging applications. Many different metal oxides are alleged to be useful as antistatic agents in photographic elements or as conductive agents in electrographic elements in such patents as U.S. Pat. Nos. 4,275,103, 4,394,441, 4,416,963, 4,418,141, 4,431,764, 4,495,276, 4,571,361 and 4,999,276. Preferred metal oxides are antimony doped tin oxide, aluminum doped zinc oxide, and niobium doped titanium oxide. However, these materials do not provide acceptable performance characteristics in the demanding application of the present invention. In order to obtain high electrical conductivity, a large amount (100–10000 mg/m$^2$) of metal oxide must be included in the conductive layer. This results in decreased transparency for thick conductive coatings. The high volume fraction of the conductive fine particle in the conductive coating needed to achieve high conductivity also results in brittle films subject to cracking and poor adherence to the support material.

Fibrous conductive powders comprising, for example, antimony doped tin oxide coated onto non-conductive potassium titanate whiskers have been used to prepare conductive layers for photographic and electrographic applications. Such materials have been disclosed in U.S. Pat. Nos. 4,845,369, 5,116,666, JP A-63098656 and JP A-63060452. Layers containing these conductive whiskers dispersed in a binder reportedly provide improved conductivity at lower volume fractions than the aforementioned conductive fine particles as a result of their higher aspect (length to diameter) ratio. However, the benefits obtained as a result of the reduced volume fraction requirements are offset by the fact that these materials are large in size (10 to 20 μm long and 0.2–0.5 μm diameter). The large size results in increased light scattering and hazy coatings. Reducing the size of these particles by various milling methods well known in the art in order to minimize light scattering is not feasible since the milling process erodes the conductive coating and therefore degrades the conductivity of these powders.

Transparent, binderless, electrically semiconductive metal oxide thin films formed by oxidation of thin metal films which have been vapor deposited onto film base are described in U.S. Pat. No. 4,078,935. The resistivity of such conductive thin films has been reported to be $10^5$ Ω/sq. However, these metal oxide thin films are unsuitable for electron beam imaging applications since the overall process used to prepare them is complex and expensive and adhesion of these thin films to the film base and overlying layers is poor.

It is toward the objective of providing an improved electron beam imaging film that is free of objectionable visual density, UV density, and mottle, and can be manufactured without the need for organic solvents such as acetonitrile that the present invention is directed.

SUMMARY OF THE INVENTION

In accordance with this invention, an imaging element for use in an electron beam recording process is comprised of a film support having, in order, on one side thereof a conductive layer comprising vanadium pentoxide, an adhesion-promoting hydrophilic colloid layer, and an imaging layer. The imaging layer is comprised of an electron-beam-sensitive silver halide emulsion and the vanadium pentoxide is present in the conductive layer in an amount sufficient to impart thereto a resistivity of less than $5\times10^8$ Ω/sq. The imaging element has a visible $D_{min}$ of no greater than 0.07 density units and an ultraviolet $D_{min}$ of no greater than 0.12 density units.

Optionally, a barrier layer that prevents dissolution of the vanadium pentoxide during processing of the imaging element can be disposed between the conductive layer and the adhesion-promoting layer. Also, an optional backing layer can be applied to the film support on the side opposite to that of the imaging layer.

The imaging element of this invention is imaged by exposure to an electron beam and such exposure is carried out in vacuum so that no gaseous medium is present which could absorb the electrons. Thus, the electron-beam-recording process of the invention comprises the steps of (1) providing an electron-beam-recording element as hereinabove described, (2) introducing the element into a vacuum chamber, (3) imagewise exposing the element within the vacuum chamber to an electron beam, and (4) processing the imagewise-exposed element to form a visible image.

DETAILED DESCRIPTION OF THE INVENTION

As hereinabove described, the electron-beam imaging film of this invention comprises a film support having thereon in order outward from the film support a conductive layer, an adhesion-promoting hydrophilic colloid layer, and an imaging layer.

The film support can be any of the well-known polymeric film supports utilized in the photographic art. Examples of such film supports include cellulose acetate film, poly(vinyl acetal) film, polystyrene film, poly(ethylene terephthalate) film, poly(ethylene naphthalate) film and polycarbonate film. Because of its strength and excellent dimensional stability, polyester film support, which is well known in the photographic art, is preferred. The thickness of the support is not critical. Support thicknesses of 0.05 to 0.25 millimeters can be employed, for example, with very satisfactory results. When a polyester support is utilized, an undercoat or primer layer is typically employed between the support and the conductive layer. Such undercoat layers are well known in the photographic art and comprise, for example, a vinylidene chloride/methyl acrylate/itaconic acid terpolymer or a vinylidene chloride/acrylonitrile/acrylic acid terpolymer.

The conductive layer of this invention comprises vanadium pentoxide as the conductive material. The use of vanadium pentoxide in antistatic layers is described in Guestaux, U.S. Pat. No. 4,203,769. The conductive layer is prepared by coating an aqueous colloidal gel of vanadium pentoxide. Preferably, the vanadium pentoxide is doped with silver. A polymer binder, such as a vinylidene chloride/methyl acrylate/itaconic acid terpolymer, a vinylidene chloride/acrylonitrile/methacrylic acid terpolymer, or an aqueous dispersible polyester ionomer, is preferably employed in the conductive layer to improve the integrity of the layer and to improve adhesion to the undercoat layer. Conductive layers containing vanadium pentoxide are highly advantageous in that they have excellent transparency and their performance is not dependent on humidity. The excellent performance of these conductive layers results from the particular morphology of this material. The colloidal vanadium pentoxide gel consists of entangled, high aspect ratio, flat ribbons about 50–100 angstroms wide, about 10 angstroms thick and about 1000–10000 angstroms long. Low surface resistivities can be obtained with very low vanadium pentoxide dry coating weights as a result of this high aspect ratio morphology. In addition, as a result of the unique fibrous morphology of the vanadium pentoxide conductive gel the weight ratio of polymer binder to vanadium pentoxide can range from about 1:5 to 200:1, but, preferably 1:1 to 10:1. The conductive coating formulation may also contain a wetting aid to improve coatability. The dried coating weight of the vanadium pentoxide contained in the conductive layer is about 2–30 mg/m$^2$, preferably from about 2–15 mg/m$^2$ in order to provide a resistivity of $5\times10^8$ Ω/sq or less, a UV density of 0.12 or less, and a visual density of 0.07 or less.

The imaging elements of this invention include an adhesion-promoting hydrophilic colloid layer interposed between the conductive layer and the imaging layer. The composition of the adhesion-promoting layer is not critical. Hydrophilic water-permeable colloids commonly used in silver halide emulsion layers are satisfactory for use in the adhesion-promoting layer of this invention. Suitable hydrophilic materials include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like.

A particularly suitable layer for use as the adhesion-promoting layer is the well-known "gel sub" layer that is commonly employed in photographic elements. A gel sub layer comprises gelatin, a gelatin hardener—typically added at a concentration of 0.01 to 5% by weight based on the weight of gelatin—matte particles and surfactant coating aids. Typically, the dry coating weight of the gel sub layer is about 40 to about 200 mg/m$^2$.

An optional barrier layer that prevents dissolution of the vanadium pentoxide conductive material during film processing can be used between the conductive layer and the adhesion-promoting layer. Such barrier layers have been described in U.S. Pat. Nos. 5,006,451 and 5,221,598 and include aqueous applied latex barrier polymers having hydrophilic functionality or heat-thickening polyacrylamide barrier polymers having hydrophilic functionality. The dry coating weight of the barrier layer is sufficient to retard dissolution of the vanadium pentoxide conductive material during film processing.

The imaging layer utilized in this invention comprises an electron-beam-sensitive silver halide emulsion containing fine-grain silver halide grains dispersed in a hydrophilic water-permeable colloid. Suitable hydrophilic colloids are the same as those described hereinabove for use in the adhesion-promoting layer, with gelatin being particularly preferred. The silver halide grains can be composed of silver chloride, silver bromide, silver bromoiodide, silver chlorobromide, silver chloroiodide, silver chlorobromoiodide and mixtures thereof. The silver halide emulsions utilized in this invention can contain various addenda that are conventionally employed in the photographic art.

It is preferred to include a protective overcoat layer which overlies the imaging layer. A suitable overcoat layer is typically comprised of cross-linked gelatin and one or more lubricants.

Typically, imaging elements of this invention comprise a backing layer which is applied to the film support on the side opposite to that of the conductive layer and imaging layer. A variety of materials can be effectively utilized as a backing layer. For example, the backing layer can be comprised of crosslinked gelatin or other hydrophilic polymers such as polyvinyl alcohol, carboxymethyl cellulose, polyacrylamides, and others. Polymers and interpolymers of ethylenically unsaturated monomers such as styrenes, (meth)acrylates, (meth)acrylamides, vinyl and vinylidene halides, vinyl acetates, olefins, itaconates, and others or condensation polymers such as polyesters and polyurethanes can also be effectively used as a backing layer. The backing layer can contain various components well known in the photographic art, for example, matting materials, lubricants, surfactants, and coating aids, crosslinking agents, and antihalation dyes.

In the present invention, the support, the conductive layer, the adhesion-promoting layer, the imaging layer and any other layers that are included are designed so that the imaging element has a UV $D_{min}$ of no greater than 0.12 density units, preferably no greater than 0.10 density units, a uniformity of UV density across the element that is preferably at least within ±0.02 density units, and a visible $D_{min}$ of no greater than 0.07 density units, preferably no greater than 0.04 density units.

The invention is further illustrated by the following examples of its practice.

EXAMPLES 1–5 AND COMPARATIVE SAMPLES A–C

Conductive layers of the invention were coated with a hopper onto a moving web of 0.10 millimeter thick poly(ethylene terephthalate) film base that had been subbed with a terpolymer latex of acrylonitrile, vinylidene chloride and acrylic acid. The coatings comprised 75 weight % methyl acrylate/vinylidene chloride/itaconic acid terpolymer latex binder and 25 weight % silver-doped vanadium pentoxide colloidal gel. These coatings were dried at 120° C. and then overcoated with an 80 mg/m$^2$ gel sub layer. In some cases a 750 mg/m$^2$ barrier layer comprised of a 15/79/6 ratio terpolymer latex of methyl acrylate/vinylidene chloride/itaconic acid was applied between the conductive layer and the gel sub. The dry coating weights for the conductive layer are given in Table 1.

Comparative conductive film supports were prepared by coating the following onto polyester film base. Comparative sample A comprised a 92/8 ratio of cuprous iodide to polyvinyl formal applied from acetonitrile to give a total dry coating weight of 325 mg/m$^2$. Comparative sample B comprised a 1/2 ratio of conductive tin oxide-coated potassium titanate whiskers (Dentall WK200 conductive whiskers, product of Otsuka Chemical Co.) to gelatin applied from an aqueous formulation to give a total dry coating weight of 690 mg/m$^2$.

An electron-beam-sensitive silver halide emulsion imaging layer was then applied onto the film supports prepared above so that the imaging layer was on the same side as the conductive layer. Comparative sample C comprised the vanadium pentoxide conductive layer, barrier layer, and gel subbing layer of Example 1, but the emulsion layer was applied onto the side of the film support opposite to that of the conductive layer.

The surface resistivity of the conductive layer prior to overcoating was measured at 20% relative humidity using a 2-point probe. UV and visible density of the emulsion coated film samples processed to $D_{min}$ were measured using an X-Rite densitometer. The $D_{min}$ processed samples were also evaluated for the presence of a mottle pattern. The ability of each sample to prevent image distortion during the electron beam recording process was determined by exposing the film samples with a 15 KeV electron beam using a rectilinear grid pattern, processing the film in conventional film processing solutions, and visually observing whether there was any geometric distortion of the grid pattern. The results are tabulated in Table 1.

TABLE 1

| Film Sample | Conductive Material | Conductive Layer Coating wt. mg/m$^2$ | Barrier Layer | $D_{min}$ Visible | $D_{min}$ UV | Resistivity Ω/sq | Image Distortion | Mottle |
|---|---|---|---|---|---|---|---|---|
| Example 1 | $V_2O_5$ | 8 | Yes | 0.03 | 0.08 | $3.0 \times 10^8$ | None | None |
| Example 2 | $V_2O_5$ | 50 | Yes | 0.03 | 0.09 | $1.6 \times 10^7$ | None | None |
| Example 3 | $V_2O_5$ | 50 | No | 0.03 | 0.07 | $5.6 \times 10^6$ | None | None |
| Example 4 | $V_2O_5$ | 100 | Yes | 0.04 | 0.11 | $3.5 \times 10^6$ | None | None |
| Example 5 | $V_2O_5$ | 100 | No | 0.04 | 0.11 | $2.6 \times 10^6$ | None | None |
| Sample A | CuI | 325 | — | 0.04 | 0.14 | $1.0 \times 10^5$ | None | Yes |

TABLE 1-continued

| Film Sample | Conductive Material | Conductive Layer Coating wt. mg/m$^2$ | Barrier Layer | $D_{min}$ Visible | $D_{min}$ UV | Resistivity Ω/sq | Image Distortion | Mottle |
|---|---|---|---|---|---|---|---|---|
| Sample B | WK200 whiskers | 690 | — | 0.10 | 0.17 | $3.0 \times 10^6$ | — | — |
| Sample C | $V_2O_5$ | 8 | Yes | 0.03 | 0.08 | $3.0 \times 10^8$ | Yes | None |

It can be seen from the results reported in Table 1 that only the imaging elements of this invention met the demanding requirements for resistivities of $5\times10^8$ Ω/sq or less, low UV and visual density, freedom from mottle, and no image distortion. Sample A comprising the cuprous iodide gave acceptable resistivity values and freedom from image distortion, but, gave unacceptable UV $D_{min}$ and objectionable mottle. Sample B comprising the conductive tin oxide-coated whiskers provided acceptable resistivities, but, gave such high values for UV $D_{min}$ and visual $D_{min}$ that no effort was made to further test this sample for image distortion. Sample C shows that when the electron beam imaging emulsion layer is applied onto the film support on the side opposite the conductive layer the conductive layer does not prevent image distortion. Thus, in the present invention it is necessary that the conductive layer be on the same side of the support as the imaging layer.

It is an important advantage of the electron-beam-recording elements of this invention that they combine a high degree of conductivity with a very low $D_{min}$. In many applications for electron-beam-recording elements, especially projection plate making in the graphics market, the low $D_{min}$ translates directly into short exposure time and, consequently enhanced productivity. Also, $D_{min}$ uniformity is a big factor in essentially all applications of electron-beam-recording elements, except geophysical, due to the need to reproduce gray scale.

The invention has been described in detail, with particular reference to certain preferred embodiments thereof, but it should be understood that variations and modifications can be effected within the spirit and scope of the invention.

We claim:

1. An electron-beam-recording process comprising the steps of:

(1) providing an electron-beam-recording element comprising a film support having, in order, on one side thereof a conductive layer, an adhesion-promoting hydrophilic colloid layer and an imaging layer, said conductive layer comprising vanadium pentoxide and said imaging layer comprising an electron-beam-sensitive silver halide emulsion, said vanadium pentoxide being present in said conductive layer in an amount sufficient to impart thereto a resistivity of less than $5\times10^8$ ohms/square, and said element having a visible $D_{min}$ of no greater than 0.07 density units and an ultraviolet $D_{min}$ of no greater than 0.12 density units;

(2) introducing said element into a vacuum chamber;

(3) imagewise exposing said element within said vacuum chamber to an electron beam; and (4) processing said imagewise-exposed element to form a visible image.

2. An electron-beam-recording process as claimed in claim 1, wherein said electron-beam-recording element additionally comprises a barrier layer that prevents dissolution of said vanadium pentoxide during processing of said element; said barrier layer being disposed between said conductive layer and said adhesion-promoting layer.

3. An electron-beam-recording process as claimed in claim 1, wherein said electron-beam-recording element additionally comprises a backing layer on the side of said film support opposite to said imaging layer.

4. An electron-beam-recording process as claimed in claim 1, wherein said film support is a polyester film.

5. An electron-beam-recording process as claimed in claim 1, wherein said film support is a poly(ethylene terephthalate) film.

6. An electron-beam-recording process as claimed in claim 1, wherein said conductive layer additionally comprises a vinylidene chloride/methyl acrylate/itaconic acid terpolymer.

7. An electron-beam-recording process as claimed in claim 1, wherein said conductive layer additionally comprises a vinylidene chloride/acrylonitrile/methacrylic acid terpolymer.

8. An electron-beam-recording process as claimed in claim 1, wherein said conductive layer additionally comprises an aqueous dispersible polyester ionomer.

9. An electron-beam-recording process as claimed in claim 1, wherein said vanadium pentoxide is present in said conductive layer in an amount of 2 to 30 mg/m$^2$.

10. An electron-beam-recording process as claimed in claim 1, wherein said vanadium pentoxide is present in said conductive layer in an amount of 2 to 15 mg/m$^2$.

11. An electron-beam-recording process as claimed in claim 1, wherein said UV $D_{min}$ is no greater than 0.04.

12. An electron-beam-recording process as claimed in claim 1, wherein said adhesion-promoting hydrophilic colloid layer is comprised of gelatin, a gelatin hardener, matte particles and a surfactant coating aid.

13. An electron-beam-recording process as claimed in claim 1, wherein the dry coating weight of said adhesion-promoting hydrophilic colloid layer is from 40 to 200 mg/m$^2$.

14. An electron-beam-recording process as claimed in claim 2, wherein said barrier layer comprises an aqueous applied latex barrier polymer having hydrophilic functionality.

15. An electron-beam-recording process as claimed in claim 2, wherein said barrier layer comprises a heat-thickening polyacrylamide barrier polymer having hydrophilic functionality.

16. An electron-beam-recording process as claimed in claim 1, wherein said electron-beam-recording element additionally comprises a protective overcoat layer which overlies the imaging layer and comprises crosslinked gelatin and at least one lubricant.

17. An electron-beam-recording process as claimed in claim 3, wherein said backing layer comprises crosslinked gelatin.

18. An electron-beam-recording process as claimed in claim 1, wherein said vanadium pentoxide is silver-doped.

19. An electron-beam-recording process comprising the steps of:

(1) providing an electron-beam-recording element comprising a poly(ethylene terephthalate) film support having, in order, on one side thereof a subbing layer comprising a terpolymer latex of acrylonitrile, vinylidene chloride and acrylic acid, a conductive layer comprising silver-doped vanadium pentoxide and a methyl acrylate/vinylidene chloride/itaconic acid terpolymer latex, an adhesion-promoting gel sub layer, and an imaging layer comprising an electron-beam-sensitive silver halide emulsion, said silver-doped vanadium pentoxide being present in said conductive layer in an amount sufficient to impart thereto a resistivity of less than $5\times10^8$ ohms/square, and said imaging element having a visible $D_{min}$ of no greater than 0.07 density units and an ultraviolet $D_{min}$ of no greater than 0.12 density units;

(2) introducing said element into a vacuum chamber;

(3) imagewise exposing said element within said vacuum chamber to an electron beam; and (4) processing said imagewise-exposed element to form a visible image.

20. An electron beam-recording process comprising the steps of:

(1) providing an electron-beam-recording element comprising a poly(ethylene terephthalate) film support having, in order, on one side thereof a subbing layer comprising a terpolymer latex of acrylonitrile, vinylidene chloride and acrylic acid, a conductive layer comprising silver-doped vanadium pentoxide and a methyl acrylate/vinylidene chloride/itaconic acid terpolymer latex, a barrier layer comprised of a methyl acrylate/vinylidene chloride/itaconic acid terpolymer latex, an adhesion-promoting gel sub layer, and an imaging layer comprising an electron-beam-sensitive silver halide emulsion, said silver-doped vanadium pentoxide being present in said conductive layer in an amount sufficient to impart thereto a resistivity of less than $5\times10^8$ ohms/square, and said imaging element having a visible $D_{min}$ of no greater than 0.07 density units and an ultraviolet $D_{min}$ of no greater than 0.12 density units;

(2) introducing said element into a vacuum chamber;

(3) imagewise exposing said element within said vacuum chamber to an electron beam; and (4) processing said imagewise-exposed element to form a visible image.

* * * * *